US005267792A

United States Patent [19]

Schlake

[11] Patent Number: 5,267,792

[45] Date of Patent: Dec. 7, 1993

[54] APPARATUS FOR TRANSPORTING FLUIDS HAVING A HIGH VISCOSITY AND METHOD OF DISPENSING THE FLUIDS THEREFROM

[75] Inventor: Bernie H. Schlake, Cincinnati, Ohio

[73] Assignee: Neyra Industries, Inc., Cincinnati, Ohio

[21] Appl. No.: 682,314

[22] Filed: Apr. 9, 1991

[51] Int. Cl.[5] ..... B01F 7/04

[52] U.S. Cl. ..... 366/293; 366/138; 366/173; 366/307; 137/899; 137/255

[58] Field of Search ..... 366/14, 15, 27, 40, 366/42, 51, 64, 66, 136, 137, 190, 195, 196, 279, 292, 293, 325, 154, 291, 307, 138; 280/837, 839; 137/899, 255, 263, 240, 565, 566, 567

[56] References Cited

U.S. PATENT DOCUMENTS

| | | | |
|---|---|---|---|
| 1,363,560 | 12/1920 | Browne | 366/14 |
| 1,991,851 | 2/1935 | Hammell | 137/567 |
| 2,048,454 | 7/1936 | Kizer | 280/5 D |
| 2,229,793 | 1/1941 | Bradley | 280/5 D |
| 2,394,431 | 2/1946 | Curtis et al. | 137/263 |
| 2,415,265 | 2/1947 | Taylor | 137/567 |
| 2,618,576 | 11/1952 | Brown et al. | 366/14 |
| 2,713,866 | 7/1955 | Kaye | 134/169 R |
| 2,932,331 | 4/1960 | Reed | 137/567 |
| 3,090,393 | 5/1963 | Valentine | 134/169 R |
| 3,360,822 | 1/1968 | Schippers | 366/161 |
| 3,375,942 | 4/1968 | Boram | 366/168 |
| 3,387,626 | 6/1968 | Morris et al. | 137/567 |
| 3,404,839 | 10/1968 | Pipkens et al. | 366/138 |
| 3,584,640 | 6/1971 | Chapman | 137/567 |
| 3,671,142 | 6/1972 | Calabrese | 137/392 |
| 4,101,158 | 7/1978 | Jones | 280/283 |
| 4,106,115 | 8/1978 | Takahashi et al. | 366/138 |
| 4,159,877 | 7/1979 | Jacobson et al. | 366/138 |
| 4,201,485 | 5/1980 | Walker | 366/156 |
| 4,320,788 | 3/1982 | Lord | 137/255 |
| 4,323,004 | 4/1982 | Sereda et al. | 366/161 |
| 4,325,560 | 4/1982 | Hirvonen | 280/5 D |
| 4,378,675 | 4/1983 | Otto | 137/567 |
| 4,395,052 | 7/1983 | Rash | 280/5 C |
| 4,403,783 | 9/1983 | Henderson | 280/5 G |
| 4,467,826 | 8/1984 | Lorentz | 137/263 |
| 4,588,299 | 5/1986 | Brown et al. | 366/8 |
| 4,599,004 | 7/1986 | Keith | 366/292 |
| 4,627,629 | 12/1986 | O'Neil | 280/5 D |
| 4,830,505 | 5/1989 | Dunton et al. | 366/138 |
| 4,844,620 | 7/1989 | Lissant et al. | 366/161 |
| 5,005,980 | 4/1991 | Zimmerman | 366/14 |
| 5,098,580 | 3/1992 | Andersen | 137/566 |
| 5,103,908 | 4/1992 | Allen | 366/137 |
| 5,150,734 | 9/1992 | Chiba | 137/567 |

*Primary Examiner*—Timothy F. Simone
*Assistant Examiner*—Reginald Alexander
*Attorney, Agent, or Firm*—Shlesinger Arkwright & Garvey

[57] ABSTRACT

A preferred embodiment is directed to an apparatus for transporting fluids having a high viscosity and complimenting dry products. The apparatus includes first and second fluid storage compartments for storing separately fluids therein. The apparatus further includes a dry freight storage area. The second fluid storage compartment is positioned intermediate the first fluid storage compartment and the dry freight storage area. Agitators are disposed in each of the first and second fluid storage compartments to agitate fluid stored therein for facilitating the dispensing process. First and second positive displacement gear pumps are operably associated with the first and second fluid storage compartments. More specifically, either the first or second positive displacement gear pumps can selectively pump fluid from both the first and second fluid storage compartments. A liquid flush system is operably associated with the first and second fluid storage compartments for insuring that the fluid contained therein is completely dispensed therefrom.

6 Claims, 3 Drawing Sheets

APPARATUS FOR TRANSPORTING FLUIDS HAVING A HIGH VISCOSITY AND METHOD OF DISPENSING THE FLUIDS THEREFROM

FIELD OF THE INVENTION

The present invention is directed to vehicles for transporting fluids having a high viscosity. More specifically, a preferred embodiment of the present invention is directed to a trailer for transporting highly viscous fluids and complementing products.

BACKGROUND OF THE INVENTION

The present invention generally relates to the transportation of fluids and in particular high viscosity liquids along with associated dry freight. It is desirable for vehicles or trailers which transport high viscosity liquids to possess one or more of the following features. The vehicle or trailer should have a low center of gravity to reduce the likelihood of accidents occurring during transportation of the stored products. A number of previously known transport vehicles, such as trucks or trailers, have a high center of gravity. One example, is the "Nordic Design" trailer. This trailer has a plurality of V-shaped storage sections to facilitate the dispensing of fluid therefrom. However, the V-shaped design significantly raises the trailer's center of gravity.

Additionally, it is desirable for the transport vehicle or trailer to be adapted to quickly and completely dispense fluid stored therein. This becomes particularly important when transporting high viscosity liquids which have a tendency to settle and adhere to the walls of the storage compartment. Also, it is advantageous for the transport vehicle or trailer to be able to transport fluid freight and dry freight simultaneously. A number of previously known trailers have been designed such that the trailer can transport dry and fluid freight, however, not at the same time.

Further, it is extremely beneficial to have a trailer and/or truck which has storage compartments positioned so that, when loaded, the front and rear axles of the transport vehicle are carrying the maximum load permitted by law.

Prior known transport vehicles lack one or more of the numerous advantageous features of the present invention disclosed herein, several of which are enumerated above.

OBJECTS AND SUMMARY OF THE INVENTION

An object of the present invention is to provide a transport vehicle which has at least one of the above identified advantageous features.

Another object of the present invention is to provide an apparatus for transporting fluids having a high viscosity which includes at least one fluid storage compartment means for storing fluid therein and at least one wheel assembly. Agitation means is operably associated with the at least one fluid storage compartment means for agitating the fluid stored therein which is disposed in the fluid storage compartment means. An apparatus formed in the manner recited above is advantageous since, inter alia, the agitation means facilitates the quick and complete dispensing of fluids stored in the fluid storage compartment means. Further, the agitation means can prevent undesirable settling of the high viscosity fluid when transported over a considerable distance.

A further object of the present invention is to provide an apparatus for transporting fluids having a high viscosity which includes a first storage compartment means for storing fluid therein, and a second storage compartment means for storing one of fluid and dry materials. A liquid flush means is operably associated with at least one of the first and second storage compartment means for directing a liquid into at least one of the first and second storage compartments to facilitate dispensing of contents contained therein. By providing a liquid flush means, the contents of the associated storage compartment means may be completely dispensed therefrom. Moreover, the liquid flush means provides a convenient means by which the storage compartment may be cleaned to receive a different fluid or dry storage material.

Yet another object of the present invention is to provide an apparatus for transporting fluids having a high viscosity which includes a first fluid storage compartment means for storing a fluid therein and a second fluid storage compartment means for storing fluids therein. First pump means is operably associated with the first fluid storage compartment means for pumping fluid therefrom. Second pump means is operably associated with the second fluid storage compartment means for pumping fluid therefrom. The second pump means includes means for pumping fluid from the first fluid storage compartment means in the event that first pump means become inoperative. The apparatus described above is desirable, because the pumping system thereof enables an individual to dispense the contents of the first fluid storage compartment means even though the first pumping means is inoperative.

Still a further object of the present invention is to provide an apparatus for transporting fluids having a high viscosity which includes a first storage compartment means for storing fluid therein and a second storage compartment means for storing fluid therein. A pump is operably associated with the first and second storage compartment means. The single pump is adapted to selectively pump fluid from the first and second storage compartment means, which arrangement is a significant improvement over previously known devices.

Yet still another object of the present invention is to provide a method of dispensing fluid having a high viscosity from a transport vehicle, comprising the steps of: a) providing trailer means including at least one fluid compartment having fluid contained therein; b) providing at least one wheel assembly; c) providing agitating means for agitating the fluid contained in the at least one fluid compartment means; and, d) providing pump means for pumping fluid stored in the fluid compartment means therefrom. By providing an agitating means for agitating the fluids contained in the fluid compartment means, the contents contained therein can be quickly and completely dispensed therefrom.

These advantages and objects as well as others will be readily apparent from a review of the specification, claims and accompanying drawings.

In summary, a preferred embodiment of the present invention is directed to an apparatus for transporting fluids having a high viscosity and complementing dry products. The apparatus includes first and second fluid storage compartments for separately storing fluids therein. The apparatus further includes a dry freight storage area. The second fluid storage compartment is positioned intermediate the first fluid storage compartment and the dry freight storage area. Agitators are disposed in each of the first and second fluid storage compartments to agitate fluid stored therein for facilitating the dispensing process. First and second positive displacement gear pumps are operably associated with the first and second fluid storage compartments. More specifically, either the first or second positive displacement gear pumps can selectively pump fluid from both the first and second fluid storage compartments. A liquid flush system is operably associated with the first and second fluid storage compartments for insuring that the fluid contained therein is completely dispensed therefrom.

DETAILED DESCRIPTION OF THE DRAWINGS

DETAILED DESCRIPTION OF THE INVENTION

The preferred embodiment of the present invention will be described hereinafter with reference made to FIGS. 1 through 6.

Figure 1:
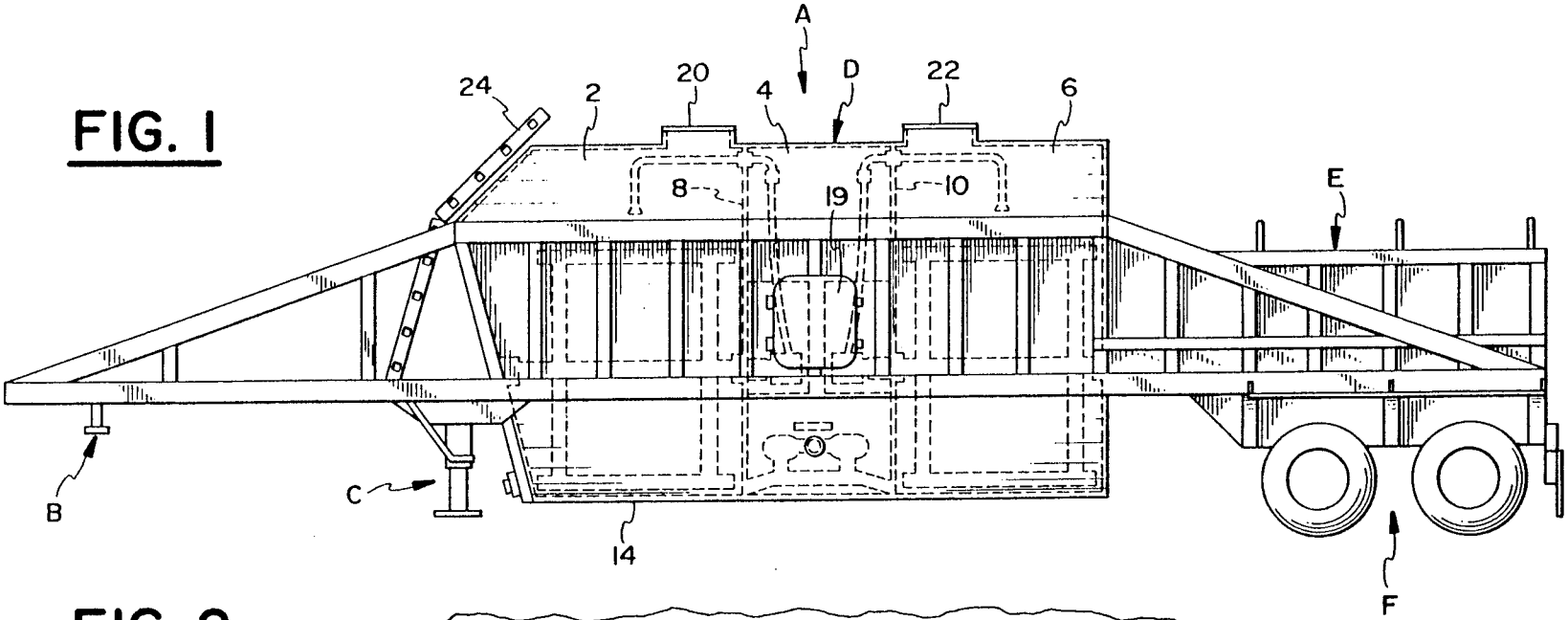
FIG. 1 is a left side elevational view of a preferred embodiment of the present invention.

Referring to FIG. 1, semi-trailer A includes a fifth wheel hitch B, front leg support C, a fluid storage container D, a dry freight storage area E and a rear wheel assembly F. The fifth wheel hitch B is of conventional design and is used to rotatably secure the semi-trailer A to a truck or other transport vehicle. The leg support C supports the semi-trailer A when it is free standing, i.e. disconnected from a truck or other transport vehicle.

Figure 4:
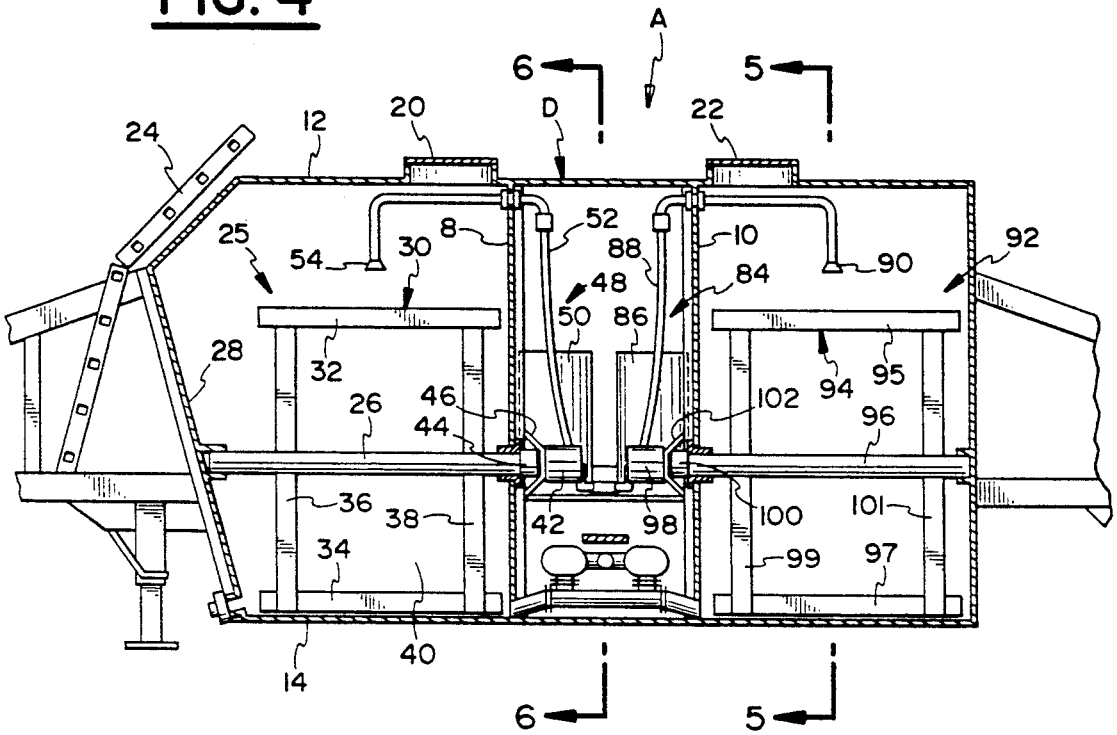
FIG. 4 is a fragmentary left side elevational view of the preferred embodiment of the present invention illustrated in FIG. 1.
Figure 5:
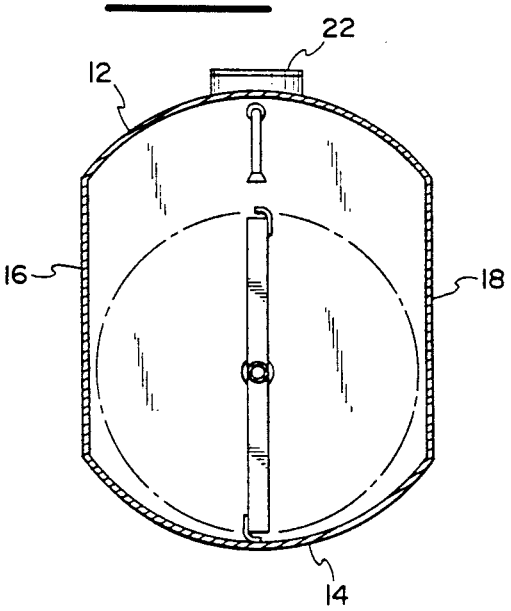
FIG. 5 is a cross-sectional view taken along lines 5—5 in FIG. 4.
Figure 6:
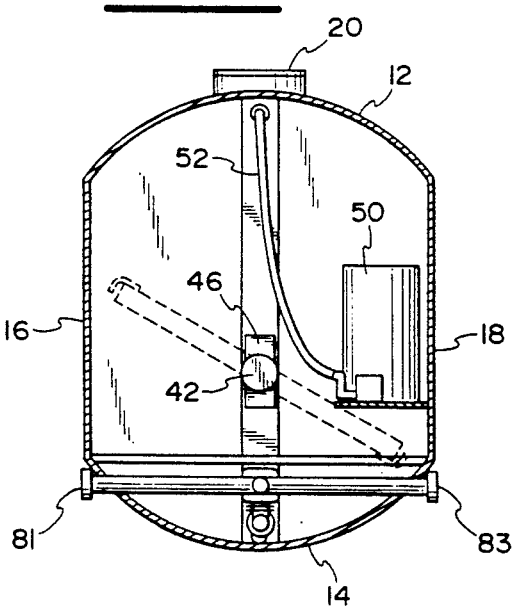
FIG. 6 is a cross-sectional view taken along lines 6—6 in FIG. 4.

The fluid storage container D is subdivided into three separate and distinct storage sections or compartments 2, 4 and 6 by partitions 8 and 10, best shown in FIG. 4. The storage compartments 2 and 6 are provided with a fluid tight seal to receive and store fluids therein. Preferably, the fluid storage compartment 2 has a capacity of 2,650 gallons whereas the fluid storage compartment 6 has a capacity of 2,300 gallons. However, the capacities of compartments 2 and 6 may be varied as desired. The storage compartment 4 is positioned intermediate the fluid storage compartment 2 and 6 and stores the mechanical components operably associated therewith.

Referring to FIGS. 1 and 3 through 6, the details of the fluid storage container D will be described hereinafter. The fluid storage container D has a substantially oval-shaped cross-section and includes a top surface 12, a bottom surface 14, left wall 16 and right wall 18. The top surface 12 and the bottom surface 14 are accurately shaped in opposite directions, i.e. top surface 12 is substantially concave and the bottom surface 14 is substantially convex as viewed from below in FIGS. 5 and 6. The convex shape of bottom surface 14 significantly lowers the center of gravity of the semi-trailer A thereby reducing the likelihood of an accident. The left and right walls 16 and 18 extend substantially parallel to each other. A door 19 is provided in the left wall 16 so that an individual can readily access the components disposed in storage compartment 4.

Manholes 20 and 22 are formed in the top surface 12 of fluid storage container D adjacent the first storage compartment 2 and the third storage compartment 6, respectively. The manholes 20 and 22 provide a resealable opening through which the first storage compartment 2 and the third storage compartment 6 are filled with fluid. The manholes 20 and 22 are of conventional design and, therefore, will not be described in detail hereinafter. A ladder 24 is provided to permit an individual to readily access the manholes 20 and 22.

Referring to FIG. 4, an agitator assembly 25 is operably associated with storage compartment 2. The agitator assembly 25 includes a support shaft 26 extending horizontally from the forward most portion 28 of storage compartment 2 to partition 8. The shaft 26 is rotatably supported by the forwardmost portion 28 and partition 6 by conventional means. The agitator assembly 25 further includes an agitator blade 30 nonrotatably secured to the shaft 26. The agitator blade 30 includes a pair of spaced horizontally extending members 32 and 34 and a pair of spaced vertically extending members 36 and 38. The vertically extending members 36 and 38 are fixed to shaft 26 and, thus, nonrotatably secure the horizontally extending member 32 and 34 thereto. The agitator blade 30 includes a substantially rectangularly-shaped opening 40 defined by the innermost surface of members 32, 34, 36 and 38. The members 32, 34, 36 and 38 may be formed from various metals or other suitable material. A flexible member may be provided along the outer edge of members 32 and 34 to wipingly engage the bottom surface 14 of storage compartment 2. As seen in FIG. 4, the agitator blade 30 extends from a position directly adjacent the bottom surface 14 of fluid storage container D to a position removed from the upper surface 12 thereof.

Shaft 26 is coupled to hydraulic agitator motor 42 via rigid coupling 44. Preferably, rigid coupling 44 is a bush type sleeve coupling manufactured by Browning. However, other conventional couplers may be used if desired. Rigid coupling 44 permits the agitator motor 42 to be readily detached from the output shaft 26 in the event that the motor 42 need be replaced or serviced. A bracket 46 mounted to the partition 8 supports the agitator motor 42 and the adjacent end of shaft 26. The hydraulic agitator motor 42 rotates the output shaft 26 in a 360° circular path which in turn rotates the agitator blade 30 along a similar circular path.

A liquid flush system 48 is operably associated with the fluid storage compartment 2. The liquid flush system 48 includes a water storage tank 50, a conduit 52, a spray nozzle head 54, a fluid pump (not shown) and a hydraulic motor (not shown). The water storage tank 50 is positioned above the bottom surface 10 of the fluid storage compartment D. One end of conduit 52 communicates wit the water storage tank 50 while the other end communicates with the spray nozzle head 54 disposed in fluid storage compartment 2 above the agitator blade 30. The fluid pump, when activated by the hydraulic motor, pumps water from the storage tank 50 through the conduit 52 to the spray nozzle head 54.

Figure 2:
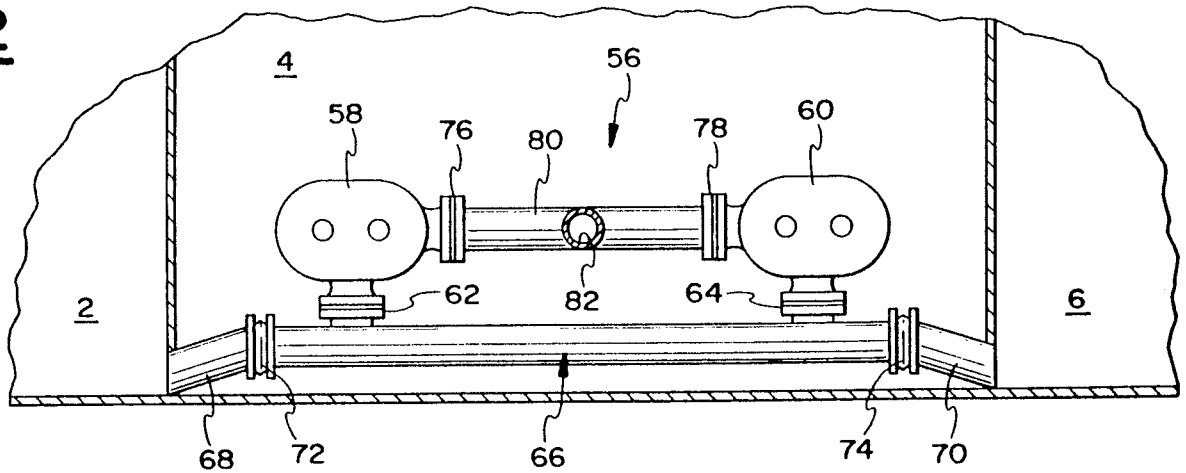
FIG. 2 is an enlarged fragmentary cross-sectional view of the preferred embodiment illustrated in FIG. 1.

Referring to FIG. 2, a positive displacement fluid pump system 56, disposed in storage compartment 4, is operably connected to the storage compartments 2 and 6. The fluid pump system 56 includes a pair of positive displacement gear pumps 58 and 60. The positive displacement gear pump 58 is positioned directly adjacent fluid storage compartment 2 whereas the positive displacement gear pump 60 is positioned directly adjacent fluid storage compartment 6. The suction ports 62 and 64 of gear pumps 58 and 60, respectively, are connected to conduit 66. Conduit 66 includes ends 68 and 70. End 68 communicates with and is positioned adjacent the bottom of fluid storage compartment 2. Similarly, the second end 70 communicated with the fluid storage compartment 6 and is disposed adjacent the bottom thereof. A pair of butterfly valves 72 and 74 are disposed in conduit 66. More specifically, butterfly valves 72 and 74 are positioned outside of suction ports 62 and 64 of pumps 58 and 60. The discharge ports 76 and 78 of pump 58 and 60, respectively, are connected to conduit 80. A conduit 82 communicates with and extends substantially perpendicular to the conduit 80. Conduit 82 passes through the left and right side walls 16 and 18 of fluid storage container D to provide a pair of discharge outlets 81 and 83, one on each side of the semi-trailer A.

A liquid flush system 84 is operably associated with the fluid storage compartment 6. The liquid flush system 84 includes a water storage tank 86, a conduit 88, a spray nozzle head 90, a hydraulic pump (not shown) and a hydraulic motor (not shown) for driving the hydraulic pump. The liquid flush system 84 is substantially identical to the liquid flush system 48 and, therefore, will not be described in greater detail.

An agitator assembly 92 is also operably associated with the storage compartment 6. The agitator assembly 92 includes an agitator blade 94 nonrotatably supported by horizontally extending shaft 96. Assembly 92 further includes a hydraulic motor 98 coupled to shaft 96 via rigid coupling 100. Rigid coupling 100 is of a similar type as rigid coupling 44. The hydraulic motor 98 and the adjacent end of shaft 96 are supported by bracket 102 fixed to the partition 10.

The agitator blade 94 is substantially identical to the agitator blade 3 and includes horizontally extending members 95 and 97 and vertically extending members 99 and 101. These members may be found from various metals or other suitable material. A flexible member may be provided along the members 95 and 97 to wipingly engage the bottom surface 14 of compartment 6.

Figure 3:
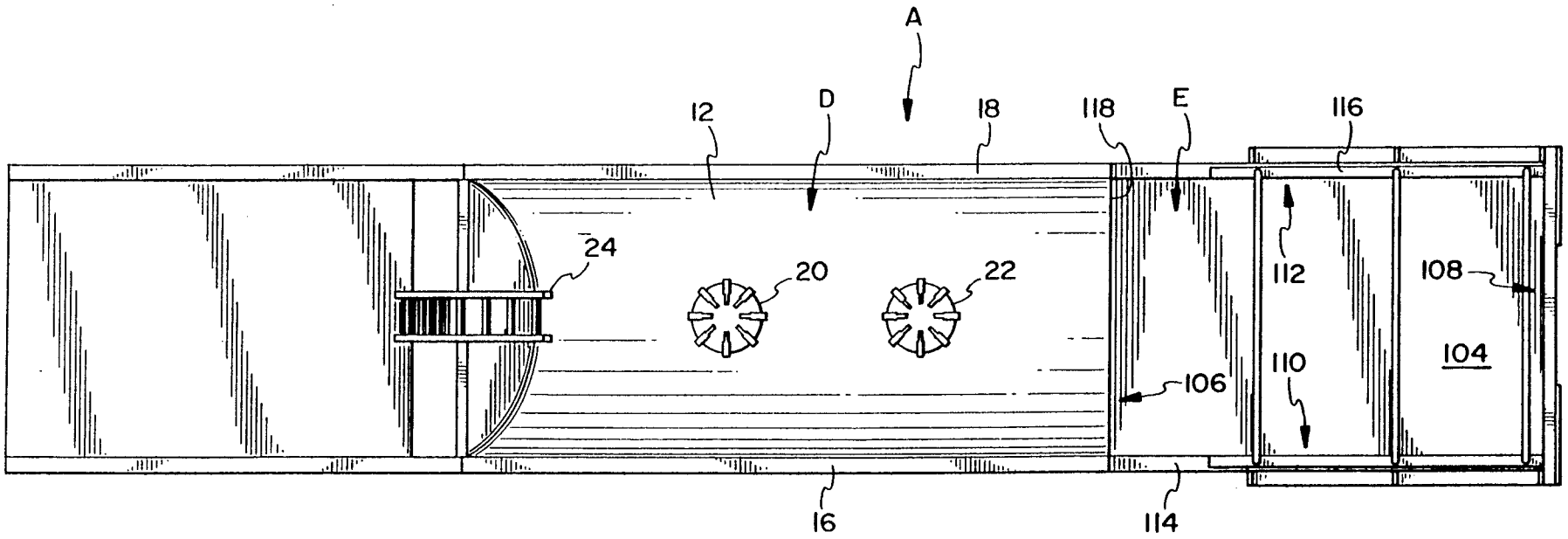
FIG. 3 is a plan view of the preferred embodiment illustrated in FIG. 1.

A dry freight storage area E is provided directly above the rear wheel assembly F. As seen in FIG. 3, the dry freight storage area includes a floor 104 having a front edge 106, a rear edge 108, a left edge 110 and a right edge 112. Left and right side walls 114 and 116 extend upward from the left and right edges 110 and 112. Rear wall 118 of fluid storage container D extends upwardly from the front edge 106. The area adjacent rear edge 108 of dry freight storage section E is unobstructed to permit the loading of the desired dry freight. It will be readily appreciated that a removable chain gate or similar device may be provided to prevent the dry freight from falling off the semi-trailer A during transport.

METHOD OF OPERATION

The preferred method of unloading the contents transported by the semi-trailer A will be described hereinafter.

Either the fluid storage compartments 2 and 4 may be emptied first. For purposes of this discussion, fluid storage compartment 2 will be emptied first. During transport the butterfly valves 72 and 74 are closed to prevent fluid stored in compartments 2 and 4 from passing through conduit 66. An individual accesses the hydraulic pump system 56 through door 19. Initially, the butterfly valve 72 is opened. A power source (not shown) is provided to selectively drive the hydraulic motors for the agitator assemblies 25 and 92, the liquid flush systems 48 and 84 and the fluid pump system 56. The power source is energized and the hydraulic motor drivingly connected to the positive displacement gear pump 58 is activated to pump the fluid from storage compartment 2 through conduit 66 and out discharge port 76. Of course, prior to pumping fluid from the storage compartment 2, the cover of the desired outlet ports 81 and 83 is removed so that the fluid may be dispensed from the appropriate side of the semi-trailer A.

The agitator motor 42 is activated before, with or after activation of the gear pump 58 to rotate blade 30 in the storage compartment 2. The agitator blade 30 travels along a circular path and facilitates the movement of the high viscosity fluid through the conduit 66 and out the appropriate discharge port. Moreover, the agitator blade 30 acts to scrape any fluid which might be adhered to the inner walls of the storage compartment 2 therefrom to insure that the fluid is completely dispensed. Once the majority of fluid has been dispensed form the fluid storage compartment 2 or any time therebefore, the hydraulic motor and pump of liquid flush system 48 is activated to direct pressurized water into the storage compartment 2.

The pressurized water further insures that all fluid stored in the storage compartment 2 is completely dispensed therefrom. Moreover, the liquid flush system 48 acts to clean the storage compartment 2 so that other fluids may be stored therein without contamination thereof. If it is learned that the gear pump 58 is inoperative, fluid may be dispensed from the storage compartment 2 by the positive gear displacement pump 60. In this instance, the butterfly valve 72 remains open and the butterfly valve 74 remains closed. The pump 60 is activated which in turn pumps fluid through conduit 66 and out the selected discharge outlet.

To dispense fluid from the storage compartment 6, butterfly valve 72 is closed and butterfly valve 74 is opened. The hydraulic motor operably connected to the pump 60 is energized which in turn causes the pump 60 to pump the fluid from the storage compartment 6 through the conduit 66 and out the selected discharge outlet. The agitator assembly 94 may be activated before, with or after the activation of the positive displacement gear pump 60. The agitator assembly 94 operates in a similar manner to the agitator assembly of compartment 2. Once the majority of fluid has been dispensed from the storage compartment 6, the liquid flush system 84 is activated to dispense pressurized water therein. The pressurized water insures that the fluid stored in the storage compartment 6 is completely dispensed therefrom. If it is found that the positive gear displacement pump 60 is inoperative, the contents of storage compartment 6 may be emptied by activating positive gear displacement pump 58 while maintaining the valve 72 closed and 74 open.

The above method of dispensing liquids from the fluid storage container D is a significant improvement over previously known methods for performing the same. Specifically, the agitator assemblies 25 and 92 associated with the fluid storage compartment 2 and 6, respectively, insure that the contents thereof are quickly and completely dispensed therefrom. Further, the liquid flush systems 48 and 94 associated with the fluid storage compartments 2 and 6, respectively further insure the complete dispensing of the contents contained therein. The dual hydraulic pump system 56 insures that the contents of both of the fluid storage compartments 2 and 6 may be emptied even though the primary pump therefore is rendered inoperative.

The positioning of fluid storage compartments 2 and 6 permit the semi-trailer A to be loaded such that the front axles of the truck and the rear axles of the trailer carry the maximum load permitted by law. More specifically, the amount of fluid stored in fluid compartment 6 can be varied depending upon the weight of the dry freight loaded in storage area E without affecting the amount of fluid stored in fluid storage compartment 2. This feature permits semi-trailer A to carry greater quantities of fluid than if a single fluid storage compartment was employed.

While this invention has been described as having a preferred design, it is understood that it is capable of further modifications, uses and/or adaptions of the invention following in general the principle of the invention including such departures from the present disclosure as come within the known or customary practice in the art to which the invention pertains, and as may be applied to the central features set forth and fall within the scope of the invention and the limits of the appended claims.

I claim:

1. An apparatus for transporting fluids having a high viscosity, comprising:

a) a first fluid storage container including first and second fluid storage compartment means for storing fluid therein;

b) said fluid storage container including a discharge outlet removed from said first and second fluid storage compartment means for discharging fluid stored in said first and second fluid storage compartment means from said fluid storage container;

c) first pump means operably associated with said first storage compartment means for pumping fluid from said first fluid storage compartment to said discharge outlet whereby the fluid can be dispensed from said fluid storage container; and, d) second pump means operably associated with said second fluid storage compartment means for pumping fluid therefrom, said second pump means including means for pumping fluid from said first fluid storage compartment means to said discharge outlet without passing through said first pump means.

2. An apparatus as in claim 1, further including:

a) a conduit communicating with and extending between said first and second fluid storage compartment means;

b) first and second valves are disposed in said conduit; and, c) said first and second pump means are positioned intermediate said first and second valves.

3. An apparatus as in claim 2, wherein:

a) said first and second pump means are adapted to alternatively pump fluid from said first fluid storage compartment means when said first valve means is open and said second valve means is closed; and, b) said first and second pump means are adapted to alternatively pump fluid from said second fluid storage compartment means when said first valve means is closed and second valve means is open.

4. An apparatus as in claim 3, wherein:

a) said first and second pump means are positive displacement gear pumps.

5. An apparatus as in claim 1, wherein:

a) said first and second fluid storage compartment means each have a substantially convex bottom surface.

6. An apparatus as in claim 1, further including:

a) first and second agitation means are operably associated with said first and second fluid storage compartment means, respectively, for agitating fluid contained therein.

* * * * *